US008196275B2

(12) United States Patent
Wessel

(10) Patent No.: US 8,196,275 B2
(45) Date of Patent: Jun. 12, 2012

(54) PERSONALIZED CASKET ORNAMENT DISPLAY SHADOW BOX

(75) Inventor: Christopher Wessel, Metamora, IN (US)

(73) Assignee: Batesville Services, Inc., Batesville, IN (US)

( * ) Notice: Subject to any disclaimer, the term of this patent is extended or adjusted under 35 U.S.C. 154(b) by 302 days.

(21) Appl. No.: 12/572,671

(22) Filed: Oct. 2, 2009

(65) Prior Publication Data

US 2011/0078882 A1 Apr. 7, 2011

(51) Int. Cl.
*A61G 17/00* (2006.01)

(52) U.S. Cl. ..... 27/10; 27/2; 40/124.5

(58) Field of Classification Search ..... 27/10, 2, 27/1; D99/8, 13; 40/124.5; 206/6.1; 63/1.11; 312/114, 138.1; 428/913.3, 542.4
See application file for complete search history.

(56) References Cited

U.S. PATENT DOCUMENTS

| | | | | |
|---|---|---|---|---|
| 4,324,026 | A | 4/1982 | Craft | |
| 5,704,103 | A * | 1/1998 | Crowley et al. | 27/1 |
| 6,543,103 | B1 * | 4/2003 | Robert | 27/10 |
| 6,557,222 | B2 | 5/2003 | Groemminger et al. | |
| 6,591,466 | B1 | 7/2003 | Acton et al. | |
| 6,691,385 | B2 | 2/2004 | Bell et al. | |
| 6,735,831 | B1 | 5/2004 | Greiwe et al. | |
| 6,883,212 | B2 | 4/2005 | Groemminger et al. | |
| 6,928,706 | B2 * | 8/2005 | Acton et al. | 27/10 |
| 7,210,204 | B2 | 5/2007 | Groemminger et al. | |
| 7,260,872 | B2 * | 8/2007 | Schultz | 27/10 |
| 7,340,810 | B2 | 3/2008 | Acton et al. | |
| 7,562,423 | B2 * | 7/2009 | Pryd-Kakuk | 27/1 |
| 7,698,792 | B1 | 4/2010 | Parker | |
| 7,904,998 | B2 * | 3/2011 | Motz et al. | 27/10 |
| 7,908,720 | B2 * | 3/2011 | Rojdev | 27/10 |
| 2009/0030804 | A1 * | 1/2009 | Sell | 705/26 |
| 2010/0011549 | A1 * | 1/2010 | Thompson | 27/1 |
| 2010/0077577 | A1 | 4/2010 | Rojdev | |
| 2010/0077578 | A1 | 4/2010 | Motz et al. | |
| 2010/0077579 | A1 | 4/2010 | Parker | |
| 2010/0077580 | A1 * | 4/2010 | Holzman | 27/10 |
| 2010/0287749 | A1 * | 11/2010 | Rojdev | 27/1 |

OTHER PUBLICATIONS 2 drawing sheets of a casket corner ornament attachment clip in public use or on sale in the United States greater than one year prior to Sep. 29, 2008.
Notice of Allowance, U.S. Appl. No. 12/240,598, 12 pages, Aug. 2, 2010.
Notice of Allowance, U.S. Appl. No. 12/240,647, 14 pages, Aug. 3, 2010.
U.S. Appl. No. 12/467,046, filed May 15, 2009.

* cited by examiner

*Primary Examiner* — William L. Miller
(74) *Attorney, Agent, or Firm* — Wood, Herron & Evans, LLP

(57) ABSTRACT

A casket ornament display comprises a shadow box comprising opposed side walls, opposed end walls, a back wall, and a transparent pane front, a casket ornament including a fastener adapted to removably secure the ornament to a casket, the casket ornament attached to the back wall of the shadow box via the fastener, and indicia attached to the shadow box identifying a deceased to be memorialized, the ornament being either a) one that was removed from the casket in which the deceased was displayed, or b) one that is substantially identical to an ornament that was secured to the casket in which the deceased was displayed.

19 Claims, 8 Drawing Sheets

PERSONALIZED CASKET ORNAMENT DISPLAY SHADOW BOX

RELATED APPLICATIONS

None.

FIELD

The subject matter herein relates to apparatus and methods for memorializing a deceased individual and, more specifically, to apparatus and methods for providing the survivors of the deceased a personalized keep sake after the deceased is buried or cremated.

BACKGROUND

When an individual passes away it is customary for the body of the individual to be viewed by family and friends at a funeral home. After the viewing, a memorial service or funeral is generally held at the funeral home or a church to commemorate the life of the deceased. Thereafter, a grave side service may be held with family and friends looking on. With the completion of the grave side service the casket is lowered into the grave where it will remain. A similar service may be held prior to or after the deceased is being cremated. Usually after cremation the cremated remains are collected and presented to the family in a cremation urn.

The casket in which the deceased is displayed and buried can be customized to fit the needs and preferences of the deceased and the family. For instance, a wide variety of materials, finishes, colors and decorative ornamentation can be chosen to meet these needs. The purchaser of a casket can also customize the casket using a variety of stylized trim or corner pieces. These stylized corner pieces usually have standardized decorative elements as chosen by the manufacture. In addition, these corner pieces typically are not personalized. Moreover, these stylized corner pieces are typically permanently mounted onto the casket and are left on the casket when the deceased is buried in the grave site. It is desirable however to more truly personalize the casket to more accurately memorialize the deceased individual.

In addition, once the casket is buried and the funeral services are completed, the families are left with few tangible reminders of the funeral and burial services. Most families receive flowers at the funeral home which pay respect to the deceased and his or her surviving family. These flowers, however, wilt and die after a short time, leaving the family with few remembrances of the funeral or burial services. It is desirable for the families to receive a more tangible and permanent reminder of the funeral or burial services.

A casket ornament attachment mechanism is disclosed in Acton et al. U.S. Pat. Nos. 6,591,466, 5,928,706, and 7,340,810 titled Quick Change Casket Corner Attachment Mechanism, assigned to the assignee of the present invention and incorporated by reference herein. The Acton et al. patents disclose an ornamental corner piece assembly having a back plate that attaches to the corner of a casket. The back plate includes a clip member having at least one keyhole groove. A decorative corner insert includes at least one attachment member that slidingly engages the keyhole groove in the clip member such that the corner insert removably couples to the back plate. In this way, a funeral director may quickly and conveniently change out the decorative corner pieces to provide a wide variety of casket designs personalized to the deceased. Such a quick change casket corner ornament is commercially available from the assignee as its LIFESYMBOLS® line of corner ornaments.

One attempt at providing a means of memorializing a deceased individual may be seen with reference to the assignee's Groemminger et al. U.S. Pat. Nos. 6,557,222, 6,883,212, and 7,210,204 titled Personalized Casket Ornament Display Plaque, hereby incorporated by reference herein. These patents disclose a casket ornament display plaque and associated methods for memorializing a deceased individual. The casket ornament display plaque comprises a decorative board, a casket ornament, for example a LIFESYMBOLS® corner ornament, attached to the board, and indicia attached to the board identifying a deceased to be memorialized. The casket ornament is one having been removed from a casket in which the deceased was displayed. The indicia may be a nameplate bearing the name of the deceased, a photograph of the deceased, or both.

Another attempt may be seen with reference to the assignee's Bell et al. U.S. Pat. No. 6,691,385 titled Personalized Casket Corner Piece Display Pedestal, hereby incorporated by reference herein. This patent discloses a casket corner piece display pedestal and associated methods for memorializing a deceased individual. The casket corner piece display pedestal has a center piece having first and second ends with a casket corner piece receiving surface disposed therebetween. The center piece includes either a memorabilia receiving container, a cremation urn, or both disposed within the first end of the center piece. A base member is attached to the second end of the center piece for supporting the casket corner piece display pedestal. The base member includes an extended portion protruding transversely to the casket corner piece receiving surface on the center piece. A cover member is removably disposed on the first end of the center piece to cover the memorabilia receiving container and/or cremation urn. The cover member includes an extended portion protruding transversely to the casket corner piece receiving surface on the center piece such that the casket corner piece display pedestal has an approximate C-shaped profile. The casket corner piece receiving surface is adapted to receive and hold a casket corner piece, for example a LIFESYMBOLS® corner ornament, so that the casket corner piece can be displayed for viewing.

An even more recent innovation may be seen with reference to the assignee's U.S. patent application Ser. No. 12/467,046 titled Casket and Memorialization Accessory, hereby incorporated by reference herein. This application discloses a casket and memorialization accessory combination comprising a casket comprising a casket shell having a pair of side walls and a pair of end walls and a casket lid closable on the casket shell, a decorative ornament comprising a digital image display device, and a keepsake box adapted to receive keepsake items therein. The casket shell, ornament, and keepsake box are configured such that the ornament is removably attachable to the casket shell and attachable to the keepsake box. The ornament, for example a LIFESYMBOLS® corner ornament, can be removed from the casket in which a deceased was displayed for viewing and attached to the keepsake box so that the keepsake box and ornament can be presented to a loved one of the deceased as a memorial to the deceased.

Despite the advancements made in the area of memorialization as demonstrated above, there remains room for improvement.

SUMMARY

In one aspect a casket ornament display comprises a shadow box comprising opposed side walls, opposed end walls, a back wall, and a transparent pane front, a casket ornament including a fastener adapted to removably secure the ornament to a casket, the casket ornament attached to the back wall of the shadow box via the fastener, and indicia attached to the shadow box identifying a deceased to be memorialized, the ornament being either a) one that was removed from the casket in which the deceased was displayed, or b) one that is substantially identical to an ornament that was secured to the casket in which the deceased was displayed.

The fastener can comprise a first attachment element secured to the back wall and a second attachment element secured to the ornament, one of the first and second attachment elements being at least one groove and the other of the first and second attachment elements being at least one fastener having a head thereon, wherein the at least one groove comprises a slot and an opening communicating with the slot, the opening being of a greater dimension than the slot, and wherein the fastener is a threaded fastener. The threaded fastener can be a screw. The screw can be a shoulder screw.

The fastener can comprise a first attachment element secured to the back wall and a second attachment element secured to the ornament, the first and second attachment elements configured such that the ornament is removably secured to the back wall via motion in first and second non-parallel directions generally parallel to a plane defined by the back wall. The first attachment element can be a plate with at least one groove therein and the second attachment element can be at least one stud. The at least one groove can include a first keyhole portion and a second non-keyhole portion. The first keyhole portion can have a first longitudinal axis, the second non-keyhole portion can have a second longitudinal axis and the first and second longitudinal axes can be non-parallel. The first and second longitudinal axes can be perpendicular. The at least one stud can be a shoulder screw. The motion in the first and second directions can be rectilinear.

The indicia can be an engraveable brass nameplate attached to the back wall. The back wall can be removable. The transparent pane front can be hinged to one of the side walls thereby permitting the transparent pane front to be swung open and closed. The shadow box can include an openable and closeable drawer positioned at an end thereof for containing items of memorabilia.

In another aspect, a method of memorializing a deceased comprises displaying the deceased in a casket having at least one selectively removable ornament including a fastener removably securing the ornament to the casket, removing the ornament from the casket, affixing the ornament in a shadow box with the fastener, and presenting the shadow box and ornament to a surviving loved one of the deceased.

In yet another aspect, a method of memorializing a deceased comprises displaying the deceased in a casket having at least one selectively removable ornament including a fastener removably securing the ornament to the casket, affixing an ornament, that is substantially identical to the ornament that was secured to the casket, in a shadow box with the fastener, and presenting the shadow box and ornament to a surviving loved one of the deceased.

In still another aspect, a casket ornament display comprises a display box comprising opposed side walls, opposed end walls, a back wall, and a lid hinged to an edge of one of the side walls and end walls, the display box having an external configuration simulative of a book, a casket ornament including a fastener adapted to removably secure the ornament to a casket, the casket ornament attached to the back wall of the display box via the fastener, and indicia attached to the display box identifying a deceased to be memorialized, the ornament being either a) one that was removed from the casket in which the deceased was displayed, or b) one that is substantially identical to an ornament that was secured to the casket in which the deceased was displayed.

The lid can have an inside surface and a pocket secured to the inside surface of the lid to retain pictures or the like.

In still a further aspect, a casket ornament display comprises a shadow box comprising opposed side walls, opposed end walls, and a back wall, a casket ornament attached to the back wall of the shadow box via a fastener, and indicia attached to the shadow box identifying a deceased to be memorialized, the ornament being either a) one that was removed from the casket in which the deceased was displayed, or b) one that is substantially identical to an ornament that was secured to the casket in which the deceased was displayed.

DRAWINGS

DESCRIPTION

Figure 1:
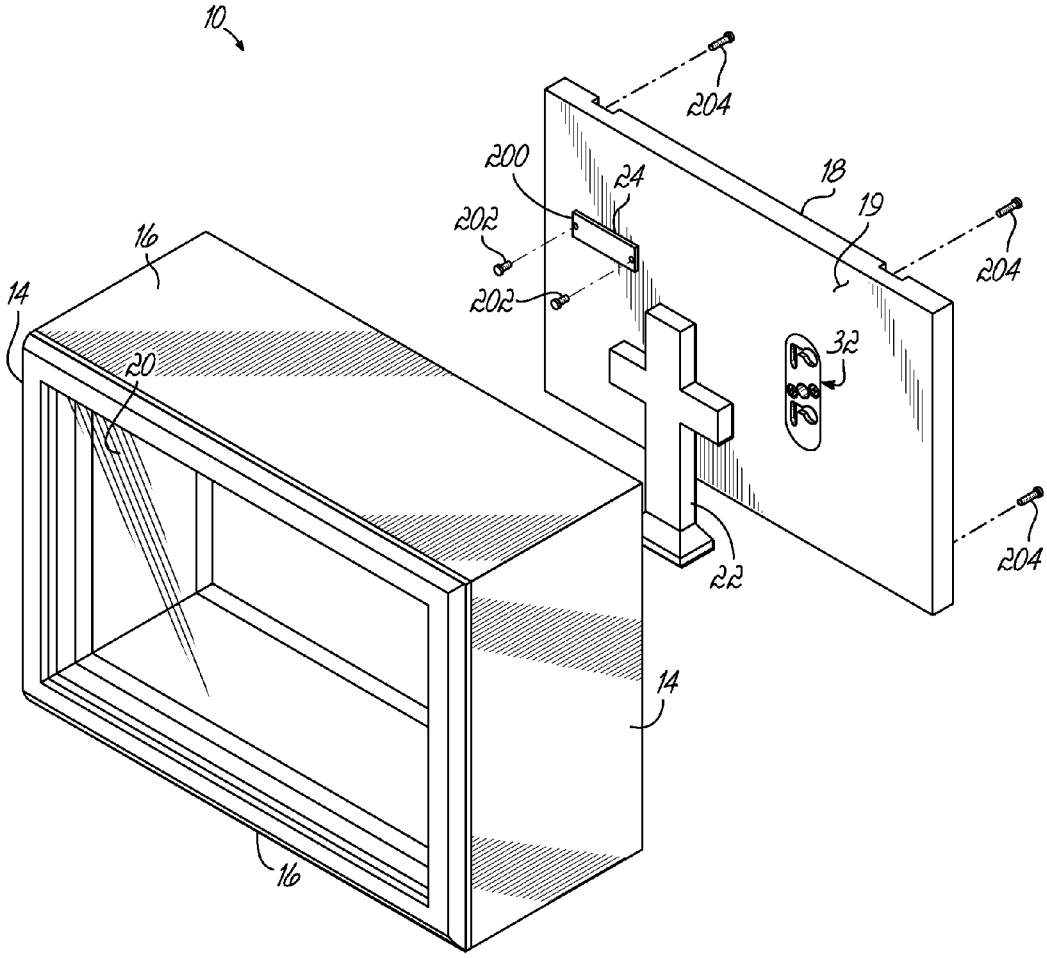
FIG. 1 is an exploded perspective view of the personalized casket ornament display shadow box.
Figure 2:
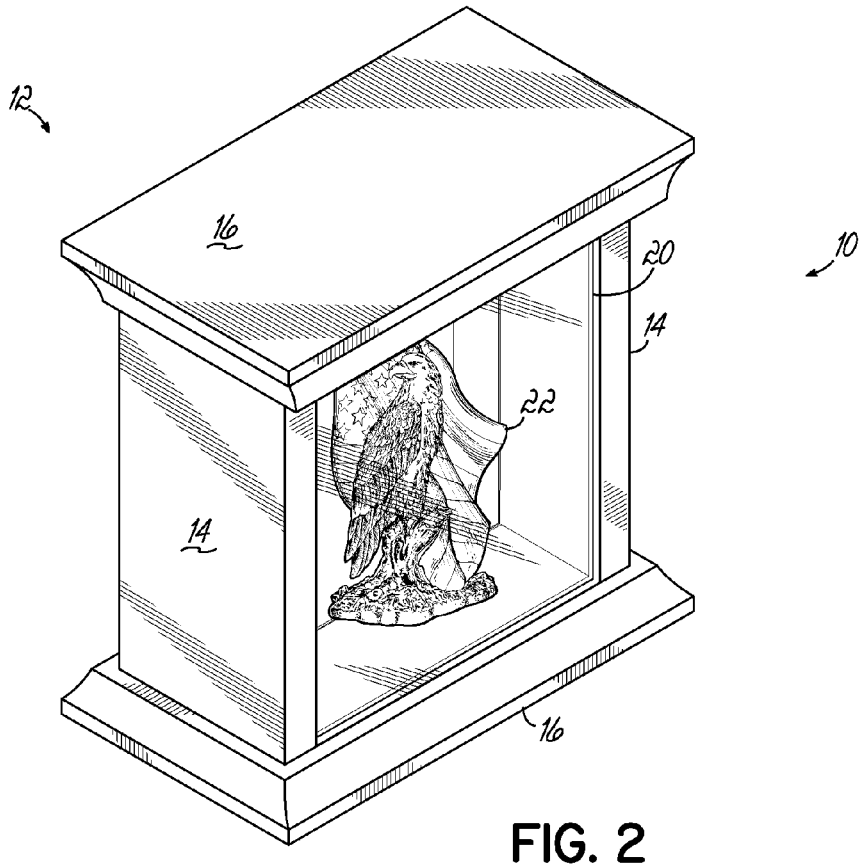
FIG. 2 is a perspective view of another embodiment of the personalized casket ornament display shadow box.
Figure 3:
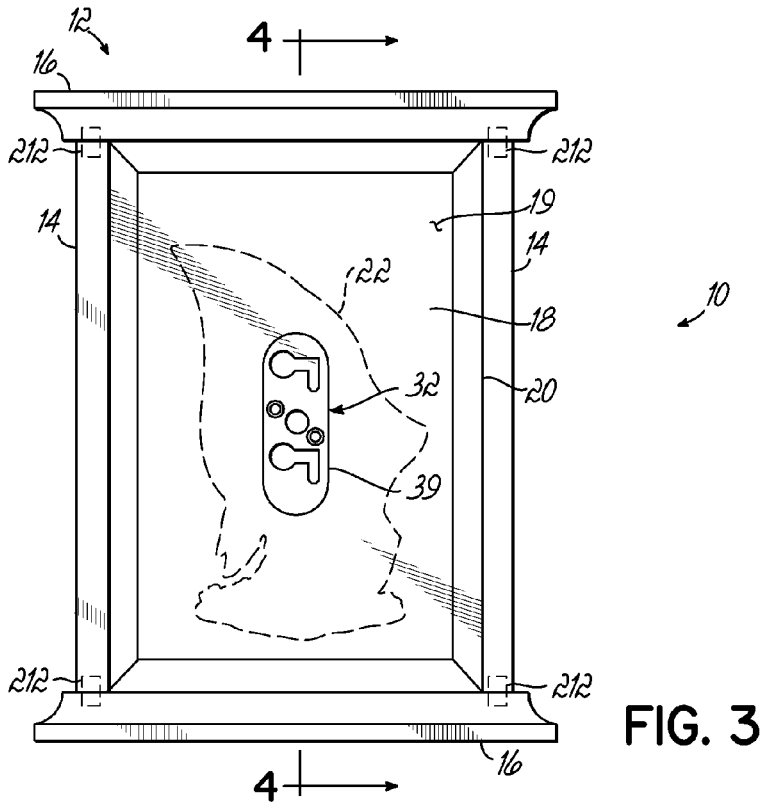
FIG. 3 is a front view of the shadow box of FIG. 2.
Figure 10:
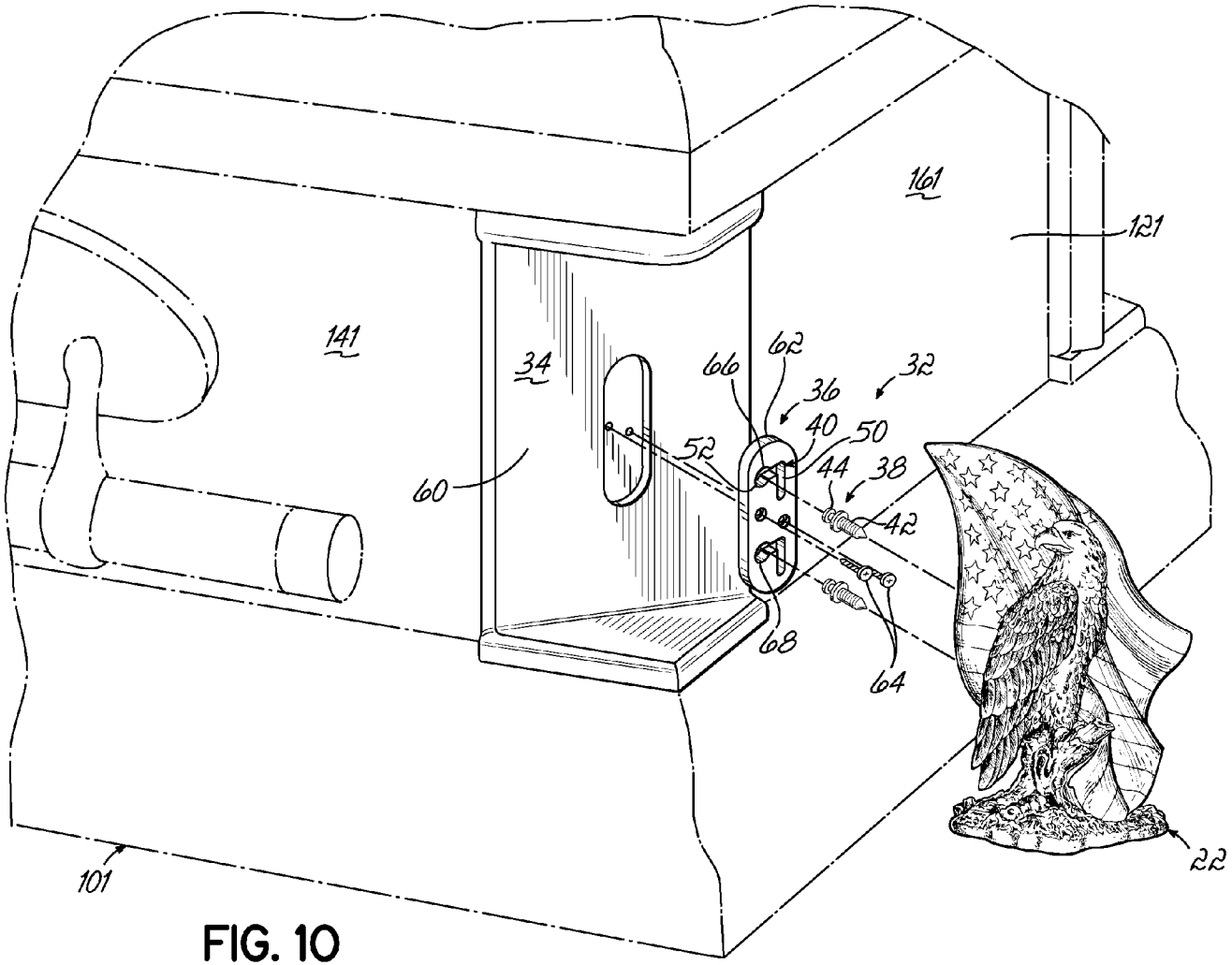
FIG. 10 is an exploded partial perspective view of a casket and ornament.
Figure 11:
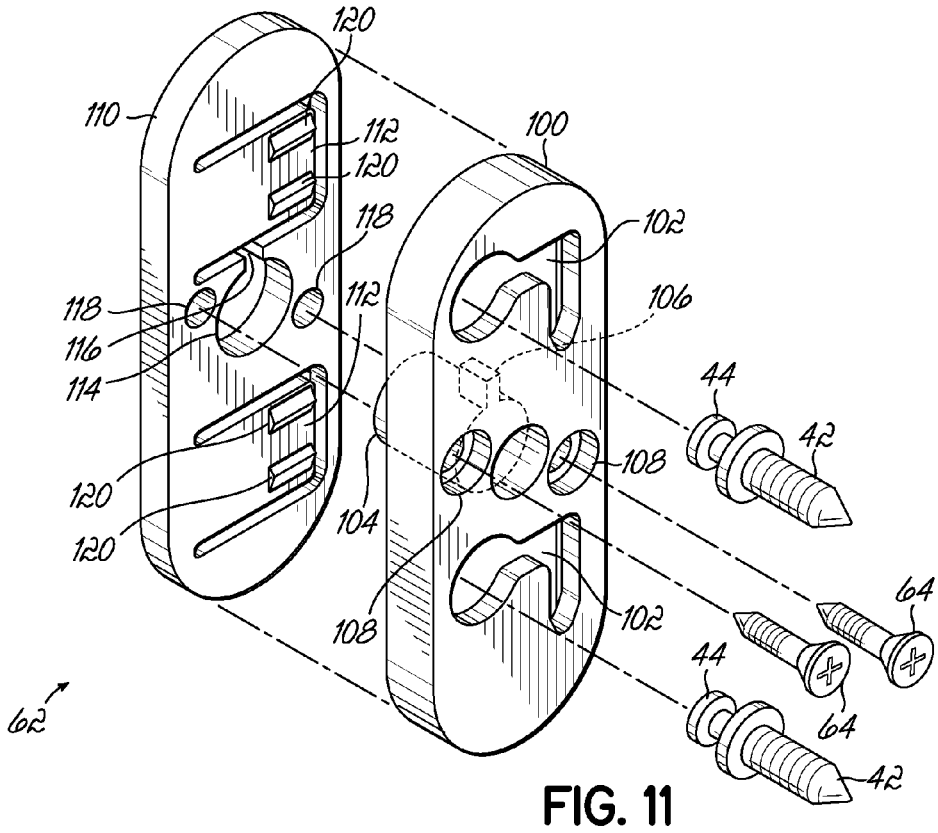
FIG. 11 is an exploded perspective view of an attachment clip for attaching the ornament to the casket.
Figure 12:
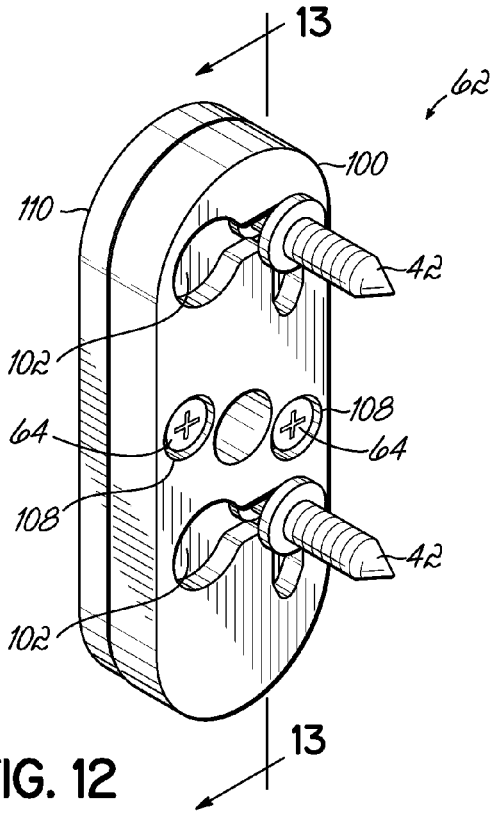
FIG. 12 is an assembled perspective view of the attachment clip of FIG. 11.

Referring first to FIG. 1, a casket ornament display 10 comprises a shadow box 12 comprising opposed side walls 14, 14, opposed end walls 16, 16, a back wall 18, and a transparent pane front 20. A casket ornament 22 including a fastener 32 adapted to removably secure the ornament 22 to a casket 101 (FIG. 10) is attached to the back wall 18 of the shadow box 12 via the fastener 32. Indicia 24 is attached to the shadow box 12 and identifies the deceased to be memorialized. The ornament 22 can either be one that was removed from the casket 101 in which the deceased was displayed, or one that is substantially identical to an ornament that was secured to the casket 101 in which the deceased was displayed. In this way that the shadow box 12 and ornament 22 can be presented to a surviving loved one of the deceased as a memorial to the deceased.

Referring now to FIGS. 1 and 10-13, the casket 101, ornament 22, and shadow box 12 can all utilize fastener 32 for removably securing the ornament 22 to a mounting surface 34 of the shell 121 of the casket 101 and for securing the ornament 22 to the shadow box 12. That fastener 32 can comprise a first attachment element 36 associated with the mounting surface 34 of the shell 121, a second attachment element 38 associated with the ornament 22, and a third attachment element 39 associated with the shadow box 12. The first 36 and second 38 attachment elements are for removably securing the ornament 22 to the shell 121, and the second 38 and third 39 attachment elements are configured for securing the ornament 22 to the shadow box 12. One of the first 36 and second 38 attachment elements can be at least one groove 40 and the other of the first 36 and second 38 attachment elements can be at least one fastener 42 having a head 44 thereon. The third attachment element 39 can be of the same type of attachment element as the first attachment element 36. The groove 40 can comprise a slot 50 and an opening 52 communicating with the slot 50, the opening 52 being of a greater dimension than the slot 50. The fastener 42 can be a threaded fastener, for example a screw. The screw can be for example a shoulder screw.

The shell 121 can have a mounting member 60 disposed between adjacent ones of the side 141 and end 161 walls, and the ornament 22 can be mounted to the mounting member 60. Accordingly in this example the mounting surface 34 is a part of the mounting member 60 of the shell 121. Mounting member 60 can be the back plate shown and described in the Acton et al patents. Other mounting surfaces and members are possible. The mounting member 60 can be oriented at about a 45° angle relative to the adjacent ones of the side 141 and end 161 walls. The first attachment element 36 can be associated with the mounting member 60, and the second attachment element 38 can be associated with the ornament 22. For example, groove 40, or a pair of grooves 40, can be formed in an attachment clip 62 secured to mounting member 60 with screws 64, and the shoulder screws 42 can be secured to the rear side of the ornament 22. The third attachment element 39 can also be a groove 40 or pair of grooves 40 formed in an attachment clip 62 secured to a mounting surface or member of shadow box 12, which as illustrated, is a front surface 19 of back wall 18.

The first 36 and second 38 attachment elements can be configured such that the ornament 22 is removably secured to the shell 121 via motion in first and second non-parallel directions generally parallel to a plane defined by the mounting member 60. The groove(s) 30 can include a first keyhole portion 66 and a second non-keyhole portion 68. The first keyhole portion 66 can have a first longitudinal axis, the second non-keyhole portion 68 can have a second longitudinal axis, and the first and second longitudinal axes can be non-parallel. For example, the first and second longitudinal axes can be perpendicular. For examples, the first and second directions can be rectilinear or curvilinear.

To install the ornament 22, the head(s) 44 of the fastener(s) 42 are inserted into opening(s) 52 of groove(s) 40; ornament 22 is then moved generally parallel to a plane defined by mounting member 18 or 60 from left to right as illustrated thus sliding head(s) 44 from left to right in slot(s) 40. The ornament 22 is then moved again generally parallel to the plane defined by the mounting member 18 or 60 downwardly thus sliding head(s) 44 down in slot(s) 50. While not required, the multi-direction movement to install ornament 22 can reduce the potential for the ornament 22 to become inadvertently dislodged.

In use, a deceased is displayed for viewing in the casket 101 to which is mounted an ornament 22. After the viewing or funeral or other memorial service, the ornament 22 is removed from the casket 101 and mounted in the shadow box 12. The shadow box 12 with ornament 22 mounted therein can then be presented to a loved one of the deceased as a memorial to the deceased. Alternatively, an ornament which is substantially identical to the ornament that was mounted on the casket can be mounted in the shadow box, if for some reason the actual ornament cannot be removed from the casket.

Figure 13A:
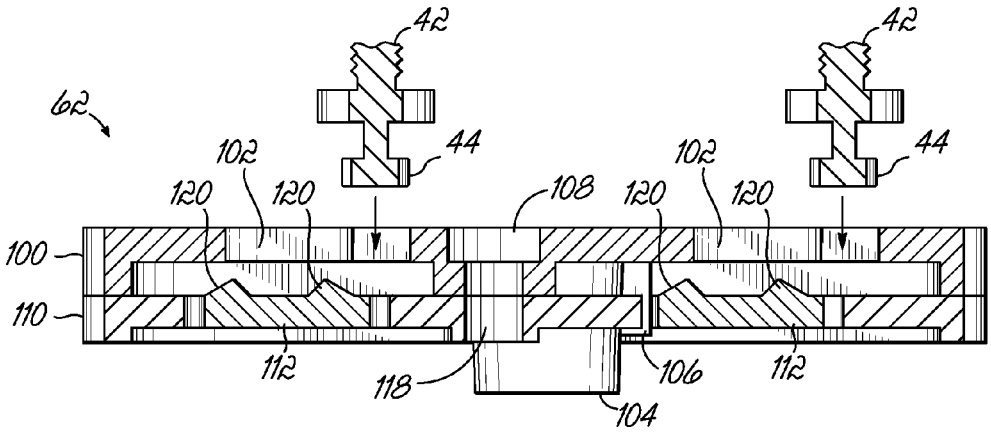
FIG. 13A is a view taken along line 13-13 in FIG. 12 showing the ornament and its fastener prior to attachment to the attachment clip.
Figure 13B:
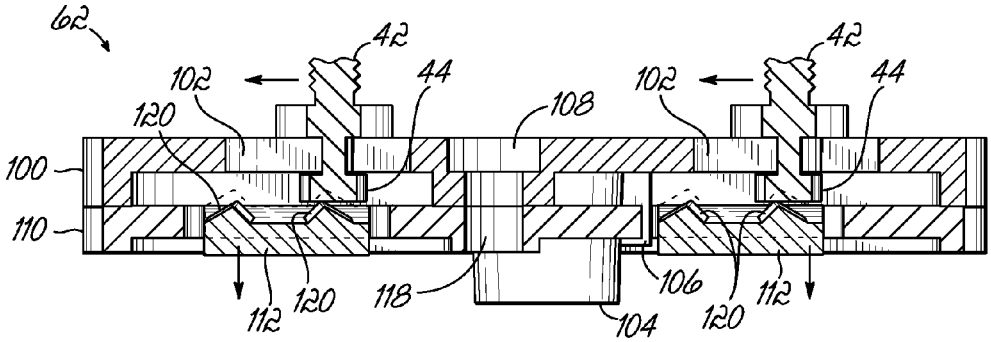
FIG. 13B is a view similar to FIG. 13A showing the ornament fastener head inserted into the attachment clip.
Figure 13C:
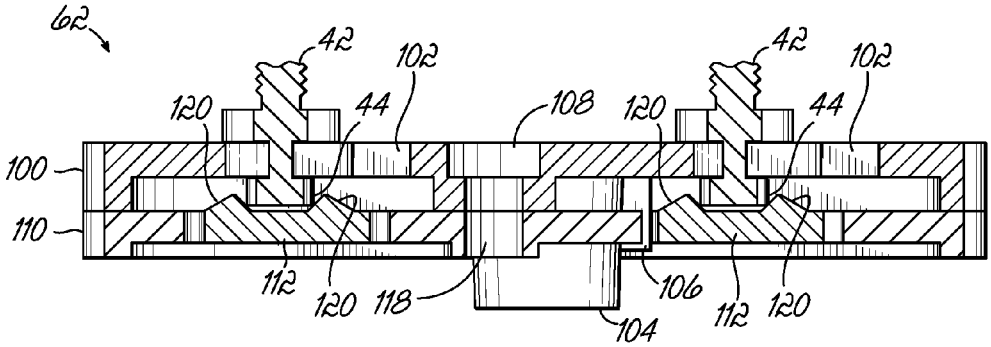
FIG. 13C is a view similar to FIG. 13B showing the ornament fastener head slid into its final position in the attachment clip and coming to rest between the two ribs on the spring tab.

Referring to FIGS. 11-13C, one form of attachment clip 62 which could be used is illustrated. The attachment clip 62 can have a front portion 100 having a pair of vertically spaced right angle keyhole grooves 102 therethrough, a rearwardly projecting circular post 104, and a rectangular rib 106 adjacent the post 104. The attachment clip 62 can have a back portion 110 having a pair of vertically spaced spring tabs 112 each of which cooperates with one of the pair of vertically spaced right angle keyhole grooves 102, a circular hole 114 for receiving the circular post 104, and a rectangular hole 116 for receiving the rectangular rib 106. Post 104, rib 106, hole 114, and hole 116 are to properly orient the front portion 100 with the back portion 110. Both portions have holes 108, 118, respectively, for receiving screws 54, rivets, etc. Each spring tab 112 can include a pair of ribs 120 which are spaced apart to accept the head 34 of fastener 32. As seen in FIGS. 13A-13C, heads 34 are inserted into keyhole grooves 102, slid to the right, and then slid down. Sliding the heads 34 down causes the spring tabs 112 to deflect rearwardly as heads 34 travel down and over the uppermost ones of the pairs of ribs 112. Once over the uppermost ones of the pairs of ribs 112, spring tabs spring forwardly retaining heads 34 between ribs 112 and against a rear surface of keyhole grooves 102.

Referring back to FIG. 1, the indicia 24 can be an engraveable brass nameplate 200 attached to the back wall 18 with screws 202. The back wall 18 can be removable to provide access to the interior of the shadow box 12 to mount ornament 22, and can be attached to the side walls 14, 14 and end walls 16, 16 of the shadow box 12 with screws 204.

Figure 4:
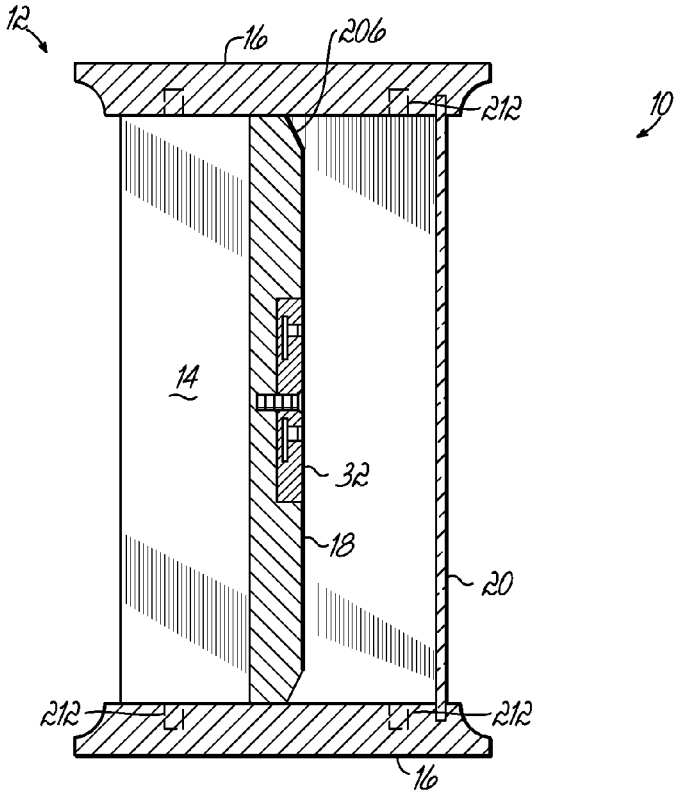
FIG. 4 is a cross-sectional view taken along line 4-4 in FIG. 3.
Figure 5:
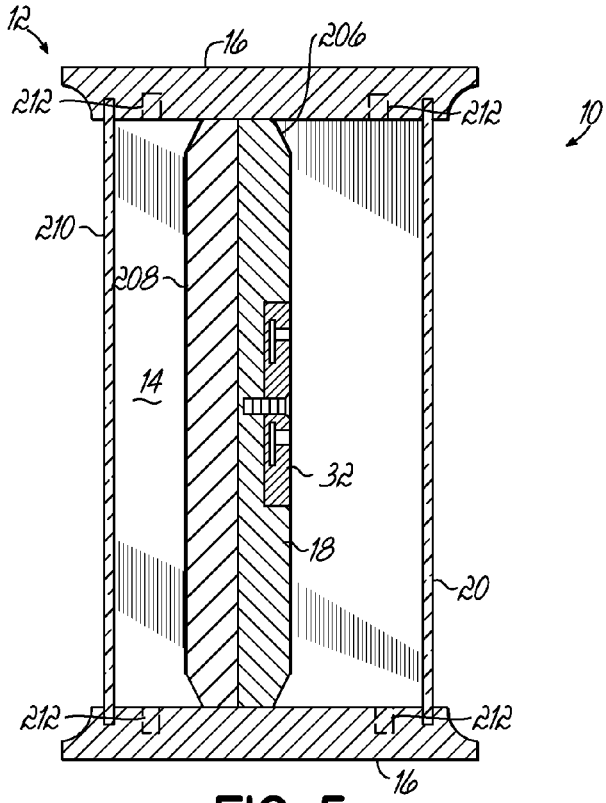
FIG. 5 is a cross-sectional view similar to FIG. 4 but of another embodiment of the personalized casket ornament display shadow box.

FIGS. 2-5 illustrate a more ornate version of the shadow box 12. In FIG. 4 back wall 18 includes a decorative bevel 206 therearound. FIG. 5 illustrates a variation having first and second back-to-back beveled display walls 18, 208. The second beveled display wall 208 can be used for additional engraving, etc. A rear transparent pane 210 can cover the second beveled display wall 208. Rather than simply glued miter joints used to join the side walls 14, 14 and end walls 16, 16 of the shadow box in FIG. 1, dowels 212 can be used to join the walls 14, 14, 16, 16 in the FIGS. 2-7 embodiments.

Figure 6:
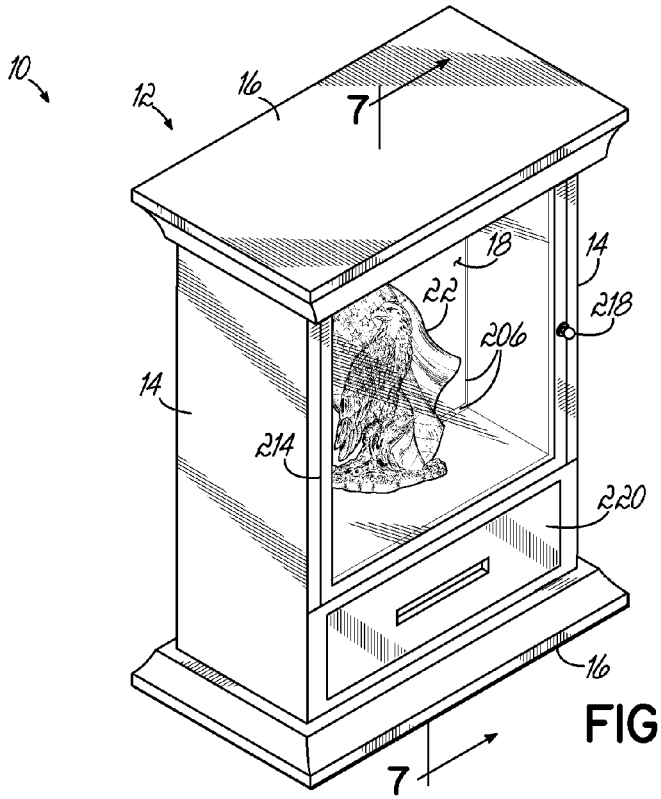
FIG. 6 is a perspective view of another embodiment of the personalized casket ornament display shadow box.
Figure 7:
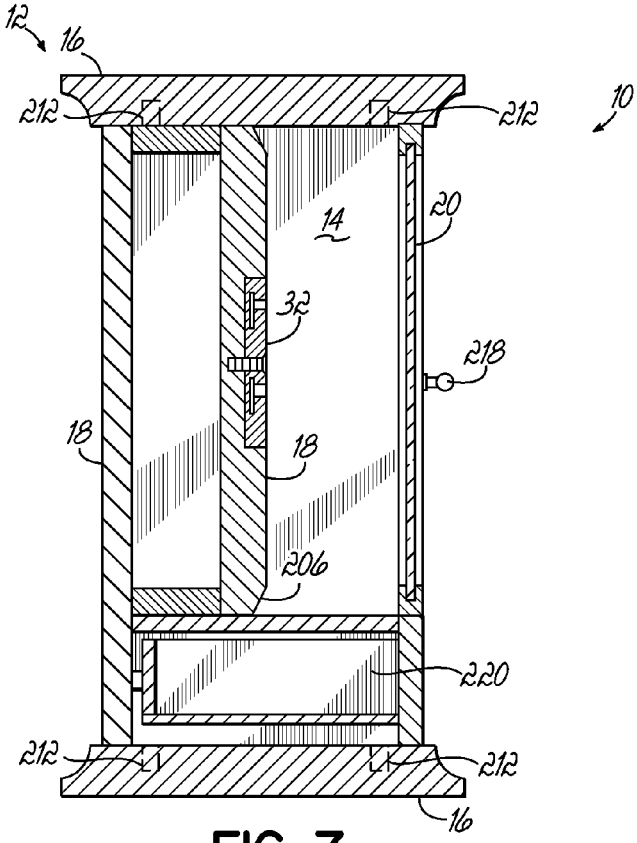
FIG. 7 is a cross-sectional view taken along line 7-7 in FIG. 6.

FIGS. 6 and 7 illustrate yet another variation of shadow box 12 wherein the transparent front pane 20 is hinged, for example along side edge 214, to permit the front pane 20 to swung open and closed to provide access to the back wall 18 from the front of the shadow box 12. The pane 20 can be contained within a frame 216. Frame 216 can be provided with a pull knob 218. This version of the shadow box 12 can also include an openable and closeable drawer 220 positioned at an end thereof (for example, positioned at the bottom end as illustrated) for containing items of memorabilia.

Figure 8:
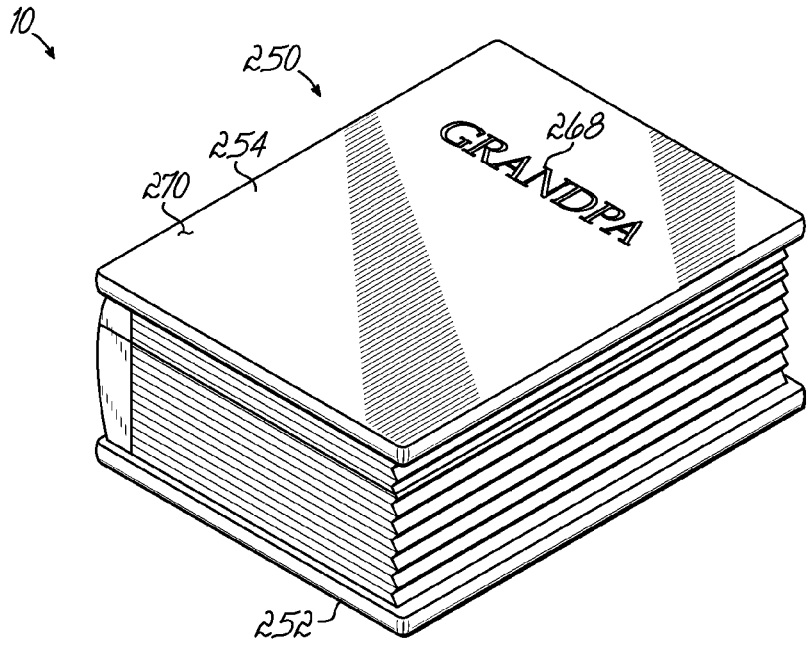
FIG. 8 is a perspective view of another embodiment of the personalized casket ornament display box.
Figure 9:
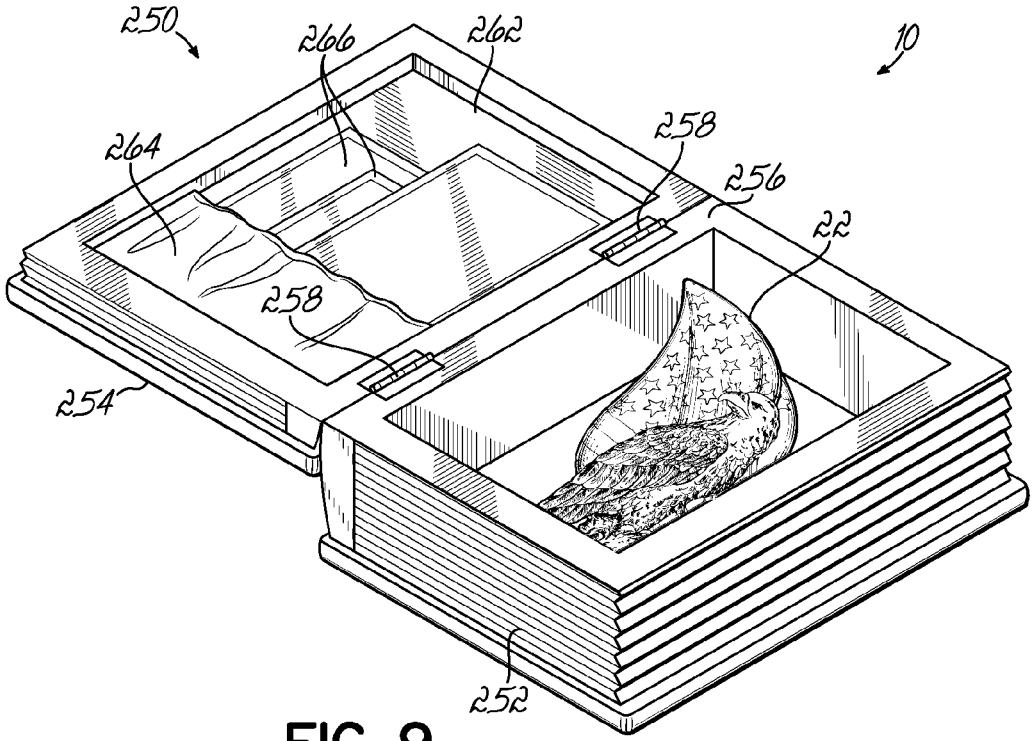
FIG. 9 is a view similar to FIG. 8 but with the casket ornament display box open.

FIGS. 8 and 9 illustrate yet another version of casket ornament display box 250 which has an exterior configuration simulative of a book. The box 250 includes an ornament 22 containing portion 252 and a lid or "book cover" 254 hinged to an edge 256 of box 250 with a pair of hinges 258. The back wall 260 includes an attachment element 39 along the lines of that described above. The inside surface 262 of the book cover 254 can include a pocket 264 to retain pictures 266 or the like. Indicia 268 such as lettering, engraving, or the like can be placed on the exterior surface 270 of the book cover 254.

Fasteners other than those shown and described could be used to attach the ornament to the display box or shadow box, for example, adhesives, double sided adhesive tape, hook and loop, magnets, ball and detent, bolts, screws, etc. Furthermore, the shadow box would not have to include the transparent front pane, i.e. the shadow box could have an open front.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. Accordingly, the scope of the right to exclude shall be limited only by the following claims and their equivalents.

What is claimed is:

1. A casket ornament display comprising:

a shadow box comprising opposed side walls, opposed end walls, a back wall, and a transparent pane front, a casket ornament including a fastener adapted to removably secure said ornament to a casket, said casket ornament attached to said back wall of said shadow box via said fastener, and indicia attached to said shadow box identifying a deceased to be memorialized, said ornament being either a) one that was removed from the casket in which the deceased was displayed, or b) one that is substantially identical to an ornament that was secured to the casket in which the deceased was displayed.

2. The casket ornament display of claim 1, wherein said fastener comprises a first attachment element secured to said back wall and a second attachment element secured to said ornament, one of said first and second attachment elements being at least one groove and the other of said first and second attachment elements being at least one fastener having a head thereon, wherein said at least one groove comprises a slot and an opening communicating with said slot, said opening being of a greater dimension than said slot, and wherein said fastener is a threaded fastener.

3. The casket ornament display of claim 2 wherein said threaded fastener is a screw.

4. The casket ornament display of claim 3 wherein said screw is a shoulder screw.

5. The casket ornament display of claim 1, wherein said fastener comprises a first attachment element secured to said back wall and a second attachment element secured to said ornament, said first and second attachment elements configured such that said ornament is removably secured to said back wall via motion in first and second non-parallel directions generally parallel to a plane defined by said back wall.

6. The casket ornament display of claim 5 wherein said first attachment element is a plate with at least one groove therein and said second attachment element is at least one stud.

7. The casket ornament display of claim 6 wherein said at least one groove includes a first keyhole portion and a second non-keyhole portion.

8. The casket ornament display of claim 7 wherein said first keyhole portion has a first longitudinal axis, said second non-keyhole portion has a second longitudinal axis and said first and second longitudinal axes are non-parallel.

9. The casket ornament display of claim 8 wherein said first and second longitudinal axes are perpendicular.

10. The casket ornament display of claim 6 wherein said at least one stud is a shoulder screw.

11. The casket ornament display of claim 5 wherein said motion in said first and second directions is rectilinear.

12. The casket ornament display of claim 1 wherein said indicia is an engraveable brass nameplate attached to said back wall.

13. The casket ornament display of claim 1 wherein said back wall is removable.

14. The casket ornament display of claim 1 wherein said transparent pane front is hinged to one of said side walls thereby permitting said transparent pane front to be swung open and closed.

15. The casket ornament display of claim 1 wherein said shadow box includes an openable and closeable drawer positioned at an end thereof for containing items of memorabilia.

16. A method of memorializing a deceased comprising:

displaying the deceased in a casket having at least one selectively removable ornament including a fastener removably securing the ornament to the casket, removing the ornament from the casket, affixing the ornament in a shadow box with the fastener, the shadow box comprising opposed side walls, opposed end walls, a back wall, and a transparent pane front and presenting the shadow box and ornament to a surviving loved one of the deceased.

17. A method of memorializing a deceased comprising:

displaying the deceased in a casket having at least one selectively removable ornament including a fastener removably securing the ornament to the casket, affixing an ornament, that is substantially identical to the ornament that was secured to the casket, in a shadow box with the fastener, the shadow box comprising opposed side walls, opposed end walls, a back wall, and a transparent pane front, and presenting the shadow box and ornament to a surviving loved one of the deceased.

18. A casket ornament display comprising:

a shadow box comprising opposed side walls, opposed end walls, a back wall, and a transparent pane front, and a casket ornament attached to said back wall of said shadow box, said ornament being either a) one that was removed from the casket in which the deceased was displayed, or b) one that is substantially identical to an ornament that was secured to the casket in which the deceased was displayed.

19. The casket ornament display of claim 18 wherein said casket ornament includes a fastener adapted to removably secure said ornament to a casket, said casket ornament attached to said back wall of said shadow box via said fastener.

* * * * *